United States Patent [19]

Cunningham et al.

[11] 4,271,004

[45] Jun. 2, 1981

[54] SYNTHETIC SEPARATOR ELECTROLYTIC CELL

[75] Inventors: Hugh Cunningham; Carl W. Raetzsch, both of Corpus Christi, Tex.

[73] Assignee: PPG Industries, Inc., Pittsburgh, Pa.

[21] Appl. No.: 56,580

[22] Filed: Jul. 11, 1979

[51] Int. Cl.[3] ..... C25B 9/04; C25B 11/03; C25B 13/04

[52] U.S. Cl. ..... 204/266; 204/283; 204/295

[58] Field of Search ..... 204/252–258, 204/263–266, 283, 295, 296

[56] References Cited

U.S. PATENT DOCUMENTS

| | | | |
|---|---|---|---|
| 3,461,057 | 8/1969 | Kamarjan | 204/258 |
| 3,883,415 | 5/1975 | Shibata et al. | 204/266 X |
| 3,981,788 | 9/1976 | Kokubu et al. | 204/266 |
| 4,065,366 | 12/1977 | Oda et al. | 204/296 X |

*Primary Examiner*—G. L. Kaplan
*Assistant Examiner*—D. R. Valentine
*Attorney, Agent, or Firm*—Richard M. Goldman

[57] ABSTRACT

Disclosed is an electrolytic cell having an electrolyte tank, planar first electrodes substantially parallel to and spaced from each other and electrically in parallel with each other in the tank, and a series of hollow second electrodes of opposite polarity to and interleaved between the planar first electrodes. The hollow second electrodes are substantially parallel to and spaced from each other and electrically in parallel with each other. An ion permeable separator is on the electrically active external surfaces of the hollow second electrodes between the planar first electrodes and the hollow second electrodes. Reactant feed and gaseous product recovery, as well as bus bars, are above the electrolyte tank thereby allowing ease of assembly and disassembly and flexibility in the number of units to be utilized.

9 Claims, 11 Drawing Figures

FIG. 1
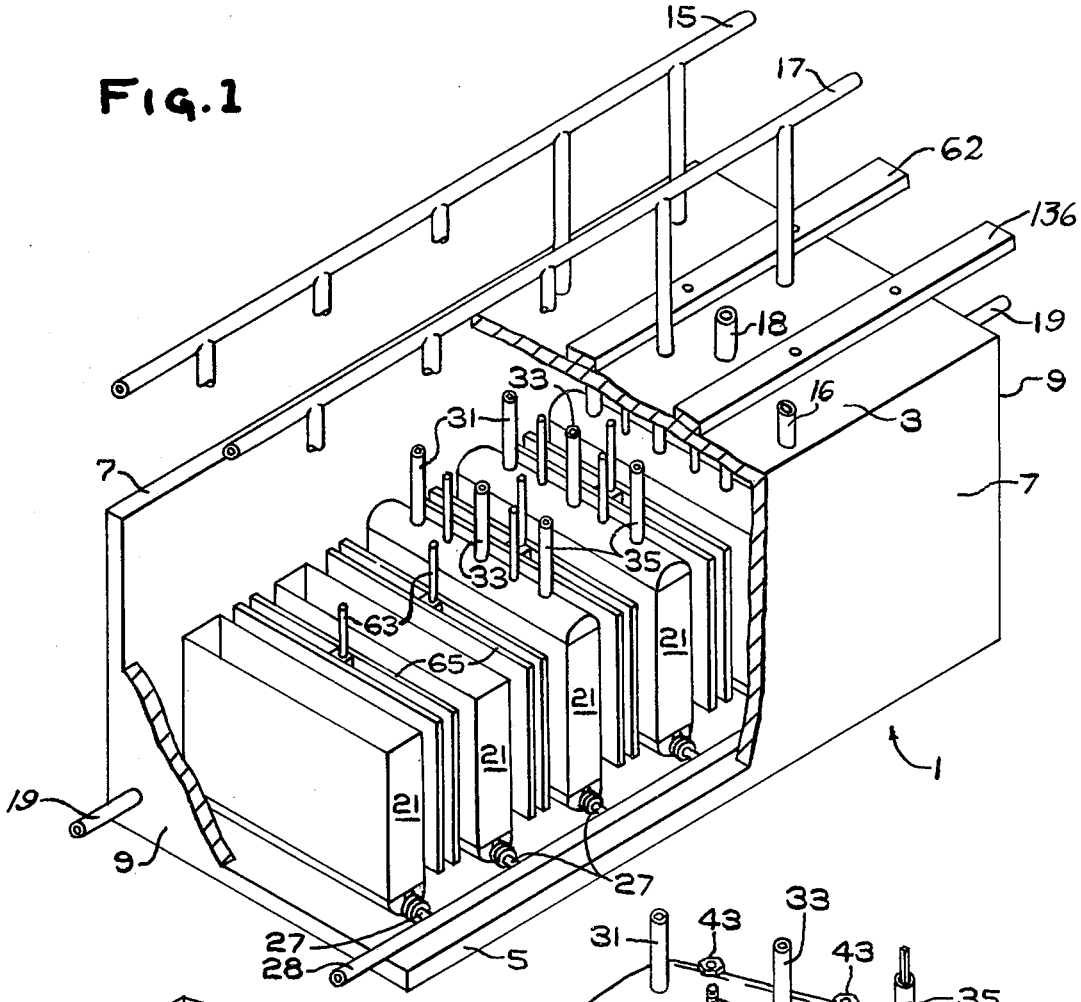
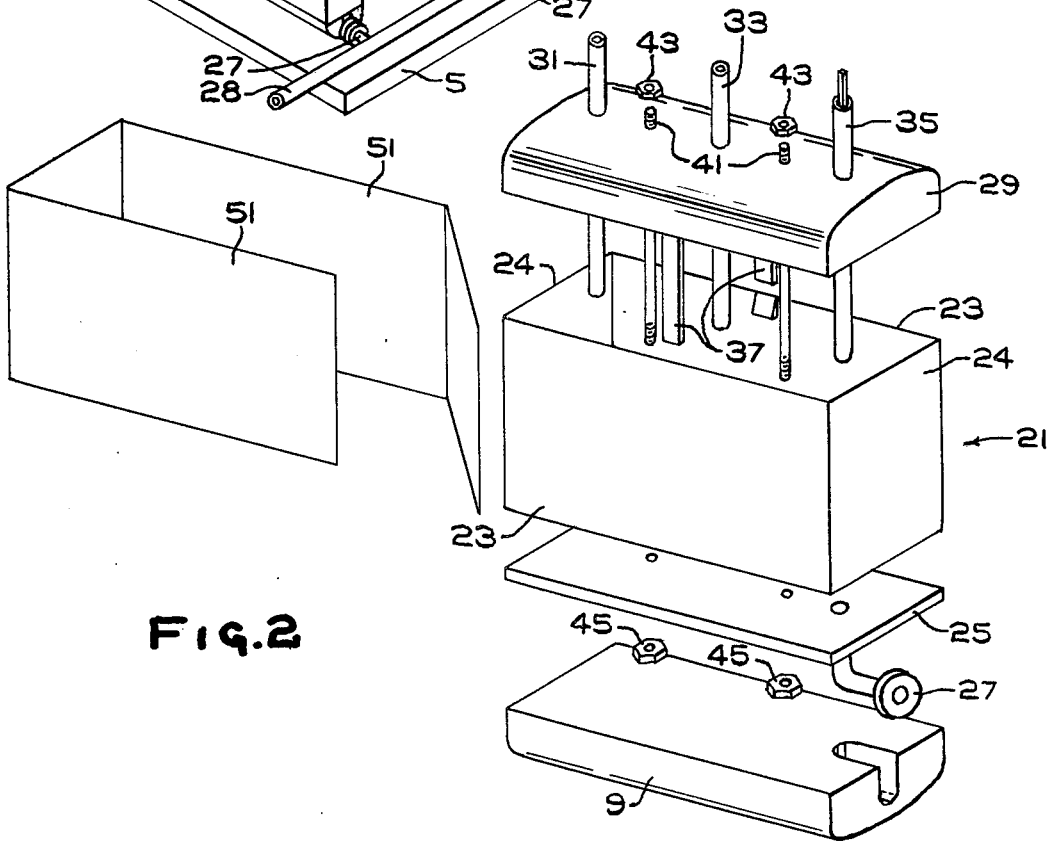
FIG. 2

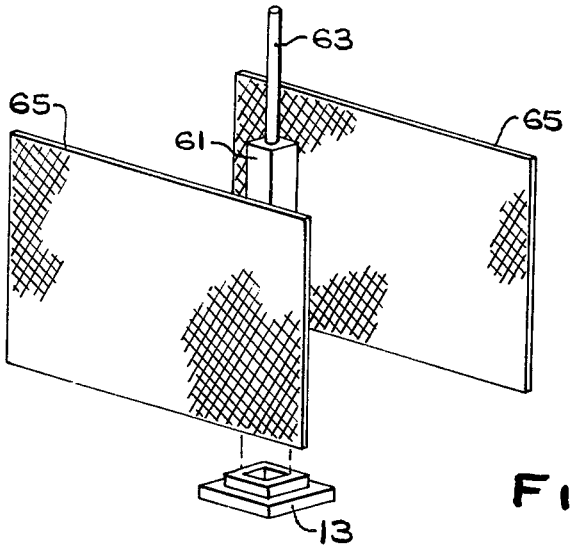
FIG. 3
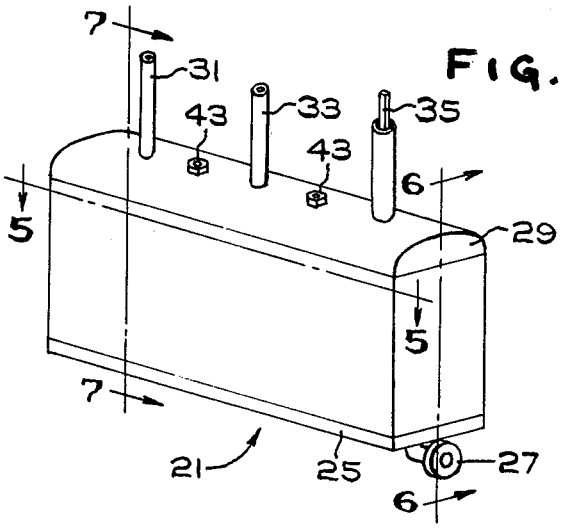
FIG. 4
FIG. 5
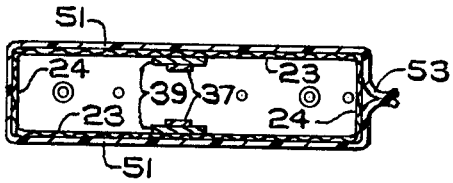
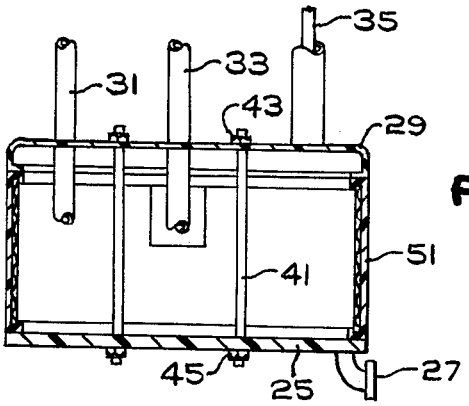
FIG. 6
FIG. 7
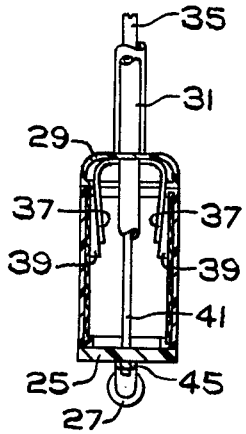

SYNTHETIC SEPARATOR ELECTROLYTIC CELL

DESCRIPTION OF THE INVENTION

Chlorine and alkali metal hydroxides, for example, potassium hydroxide and sodium hydroxide, may be prepared in an electrolytic cell having an anolyte compartment separated from a catholyte compartment by a separator. In an electrolytic cell where the anolyte and catholyte compartments are separated from one another, the anolyte compartment has an acidic anolyte containing about 125 to about 225 grams per liter of alkali metal chloride at a pH of from about 2.5 to about 5.5, with chlorine being evolved at an anode therein. The catholyte compartment has an alkaline catholyte containing more than one mole per liter of alkali metal hydroxide, for example, 10 or 14 or more moles per liter of alkali metal hydroxide, with hydrogen being evolved at the cathode therein.

The separator separates the acidic anolyte from the alkaline catholyte. The separator may be either a microporous diaphragm or a permionic membrane. Microporous diaphragms, i.e., microporous fluorocarbon films, allow both anions and cations to diffuse to the separator, thereby providing a cell liquor of about 10 to 15 weight percent alkali metal hydroxide and about 15 to about 25 weight percent alkali metal chloride.

The synthetic separator may, alternatively, be a permionic membrane. The permionic membrane may be a cation selective permionic membrane. Cation selective permionic membranes useful in chlor-alkali electrolysis include fluorocarbon resins with pendent acid groups thereon, such as carboxylic acid groups, sulfonic acid groups, phosphonic acid groups, phosphoric acid groups, derivatives thereof, and precursors thereof. Permionic membranes provide a substantially chloride free cell liquor containing from about ten to about fifty weight percent alkali metal hydroxide.

The fluorocarbon materials useful in forming the aforementioned synthetic separators are difficult to form into the shapes necessary for banks of fingered, interleaved electrodes. The provision of seams, joints, seals and convolutions requires the combinations of high temperatures, high pressures, and strong reagents, any or all of which may have a deleterious effect upon the electrodes.

It has now been found that a particularly advantageous electrolytic cell design, offering flexibility in plant operations as well as ease of installing the synthetic separator, is one having an electrolyte tank, planar first electrodes parallel to each other in the tank, depending from bus bars atop the tank, and hollow, ion permeable separator bearing, second electrodes of opposite polarity to the first electrodes in the tank, interleaved between the planar first electrodes. The hollow second electrodes are dependent from bus bars, electrolyte feed means and gaseous product recovery means above the electrolyte tank.

THE FIGURES

FIG. 1 is a partial cutaway isometric view of an electrolytic cell of the type herein contemplated.

FIG. 2 is an exploded isometric view of the hollow cathode useful in the electrolytic cell herein contemplated.

FIG. 3 shows the planar electrodes, and associated cell tank hardware for the electrolytic cell herein contemplated.

FIG. 4 shows an isometric view of the hollow electrode of the electrolytic cell herein contemplated.

FIG. 5 is a cutaway view of the hollow electrode of FIG. 4 taken along cutting plane 5—5.

FIG. 6 is a cutaway side elevation of the hollow electrode of FIG. 4 taken along cutting plane 6—6.

FIG. 7 is a cutaway end elevation of the hollow electrode of FIG. 4 taken along cutting plane 7—7.

DETAILED DESCRIPTION OF THE INVENTION

Figure 8:
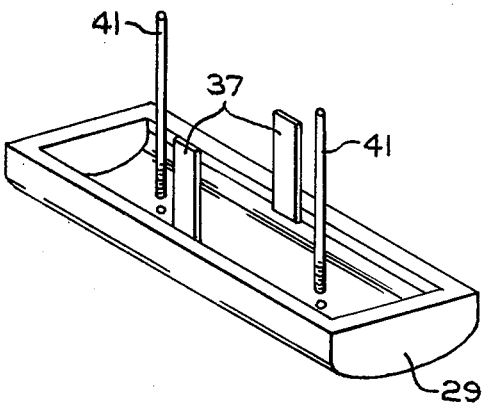
FIG. 8 is an inverted view of the cell top of the hollow electrode of FIG. 4.
Figure 9:
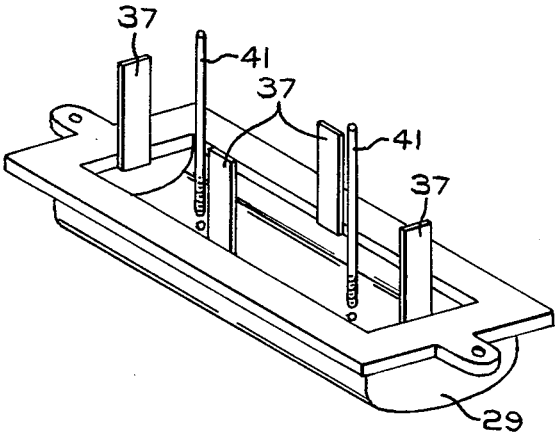
FIG. 9 is an inverted view of an alternative exemplification of the cell top of the hollow electrode of FIG. 4.
Figure 10:
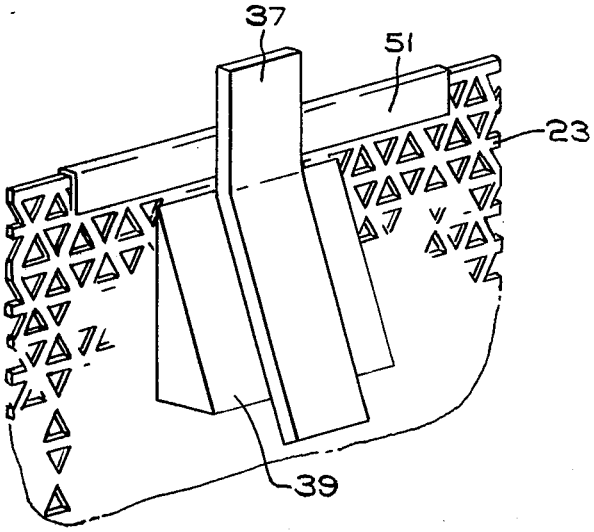
FIG. 10 is a view of the electrical conduction means of the hollow electrode of FIG. 4.
Figure 11:
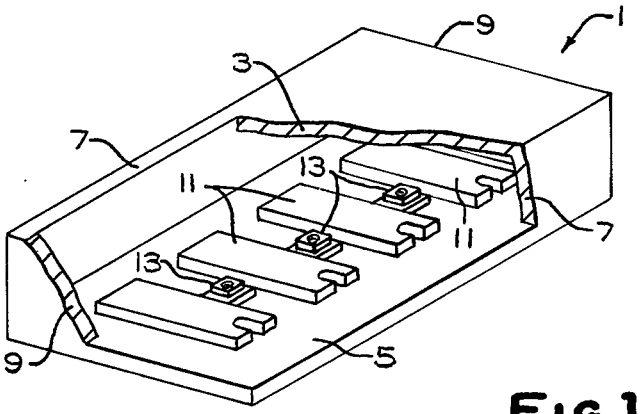
FIG. 11 is a view of the cell tank utilizing the method of this invention.

The electrolytic cell herein contemplated has an electrolyte tank 1 having a top 3, a bottom 5, sidewalls 7, and endwalls 9. The tank 1 is fed through electrolyte feed line 15 which may extend to the bottom half of electrolyte tank 1, and discharges its product through gas recovery line 17 and electrolyte recovery line 19.

The electrolyte tank 1 may be fabricated of an acidified brine anolyte resistant material when the liquor therein is anolyte liquor. The acidified brine anolyte resistant materials include the valve metals. By valve metals are meant those metals which form an oxide upon exposure to acidified brines under anodic conditions. The valve metals include titanium, tantalum, tungsten, zirconium, hafnium, and niobium. Alternatively, the acidified brine resistant electrolyte tank 1 may be provided by an iron or steel tank having an acidified brine anolyte resistant coating therein. An acidified brine anolyte resistant coating may be a film, sheet, or layer of a valve metal as described above. According to a still further exemplification, the acidified brine anolyte resistant coating may be a sheet, film, or laminate of a fluorocarbon polymer.

According to an alternative exemplification of this invention, the electrolyte tank 1 may be an aqueous alkali metal hydroxide resistant tank, as where the liquor therein is catholyte liquor. When the liquor in the tank 1 is catholyte liquor, the tank 1 may be fabricated of iron, steel, stainless steel, or mild low carbon steels.

Within the tank 1 are planar first electrodes 65 which are parallel to, spaced from, and electrically in parallel with each other. The opposite electrodic surfaces of the planar first electrodes 65 may be fabricated of an anolyte resistant material where the planar first electrodes 65 are anodes. The anolyte resistant materials are the valve metals, described above, which, when utilized as anodes, have an electrocatalytic coating thereon. By an electrocatalytic coating is meant a coating which either catalyzes the evolution of chlorine upon transfer of an electron, allows electron transfer to occur in the presence of the oxide of a valve metal, or catalyzes the electron transfer.

Alternatively, where the planar first electrodes 65 are cathodes, the cathode 65 may be iron, steel, stainless steel, or mild low carbon steel, with a suitable depolarization or hydrogen evolution catalytic coating thereon.

The planar first electrodes 65 may be electrolyte impermeable as an imperforate sheet or plate. Alternatively, they may be electrolyte permeable as a perforated sheet, perforated plate, mesh, expanded metal mesh or the like, having an open area of from about 30 percent to about 70 percent.

The planar first electrodes 65 are carried on a vertical riser 61 bearing at least one electrodic surface 65, and in a preferred exemplification two electrodic surfaces 65 on opposite sides of the vertical riser 61. The vertical riser 61 is preferably suspended from the cell top 3, in contact with the first bus bar means 62 above the cell tank 1.

The individual planar first electrode surfaces 65 on the said riser 63 may be adjustable whereby to maintain a minimum electrodic gap between the planar first electrode 65 and the electrodic surfaces 23 of the hollow electrode 21. Alternatively, they may be immovably affixed to the riser.

The planar first electrodes 65 and the electrode riser 61 are supported by suitable fittings 13 in the cell bottom.

The hollow second electrodes 21 include an electrode box 21 having side walls 23 facing the planar first electrodes 65 and narrower end walls 24 perpendicular thereto, an electrode top 29 and an electrode bottom 25 resting on cell bottom 5 or, alternatively, in a suitable platform 9 on the cell bottom 5.

The electrically active side walls 23 are parallel to the first planar electrodes 65. The electrodic side walls 23 facing the planar first electrodes 65 are normally the only electrolytically active surfaces, although all four walls 23 and 24 may be electrically active.

The hollow second electrodes 21 are parallel to, spaced from, and electrically in parallel with each other.

Where the hollow second electrodes 21 are anodes, they are fabricated of a valve metal as described above, having a suitable electrocatalytic surface thereon. Alternatively, where the hollow second electrodes are cathodic, they are fabricated of iron, steel, mild low carbon steel, or stainless steel as described above.

The walls 23,24 may be of any electrolyte permeable form, for example, perforated sheets, perforated plates, mesh, expanded metal mesh or the like. Alternatively, the narrower end walls, 24, may be electrolyte impermeable.

Second bus bar means 136 above the tank are electrically and mechanically in series with the hollow electrodes 21 through current connectors 35 which pass through the electrode top 29 to contact with internal bus bars 37. The internal bus bars 37 contact a conductor, for example, wedge 39, which may be copper, on the internal surface of the electrode 23 whereby to provide electrical conductivity from the bus bars through the electrode top 29, to the electrodic surfaces 23 of the hollow electrode 21.

The hollow electrode system 21 further includes electrolyte feed lines 31, gas recovery lines 33 and electrolyte recovery line 27 to a header.

The electrode top 29 is electrolyte impermeable with electrolyte feed 31, and gas recovery 33 lines. Bolts 41 pass through nuts 43 and 45, maintaining an electrolyte tight seal, whereby to avoid seepage of electrolyte from the inside of the tank 1 to the inside of the hollow electrode 21.

The bottom 29 of the hollow electrode 21 includes electrolyte recovery means 27 to header 28. The electrode bottom 25 is substantially electrolyte impermeable, resting on an electrode resistant mount or support in the cell bottom 5.

The ion permeable separator 51 is on the external surfaces 23 of the hollow electrode 21. The ion permeable separator means 51 between the electrolytically active surfaces 23 of the hollow electrode 21 and the planar first electrodes 65 separates the electrolyte within the hollow electrode 21 from the electrolyte within the rest of the tank 1.

The ion permeable separator 51 may be a single sheet wrapped around the four vertical walls 23 and 24 of the hollow electrode 21. This is especially desirable, e.g., to avoid fabricating steps, where the hollow electrode is narrow, having a low ratio of the area of the electrolytically inactive perpendicular end walls 24 relative to the area of the electrically active side walls 23. In the exemplification where a single sheet of ion permeable separator material 51 is wrapped around the all four vertical walls 23, 24 of the hollow electrode 21, the sheet is joined at one edge, for example, on a lap, as by heat sealing. Alternatively, one sheet may be applied on each active surface 23 and gasketed or suitably strapped in place so that only those surfaces of the hollow electrode 21 that are catalytically active, i.e., surfaces 23, bear a synthetic separator sheet thereon, the electrolytically inactive surfaces 24 being electrolyte impermeable.

The synthetic separator 51 may be a permionic membrane. By a permionic membrane is meant a polymeric fluorocarbon material having ion selective pendent groups such as sulfonic acid groups, carboxylic acid groups, phosphonic acid groups, phosphoric acid groups, precursors thereof or reaction products thereof, whereby to provide a cation selective, anion blocking film. Alternatively, the synthetic separator may be a microporous diaphragm, that is, a polymeric fluorocarbon sheet or film having pores therein of from about 1 to about 10 microns in diameter whereby to allow the limited flow of electrolyte therethrough.

In a preferred exemplification, the tank 1 has water feed 16, hydrogen recovery means 18 and hydroxyl recovery line 19, and the planar cathodes 65 are iron, steel, or stainless steel, having cathodic bus bars 62 and a cathode riser 63. In the preferred exemplification, the hollow anodes 21 are fabricated of a valve metal and have brine feed means 31 and part of recovery through chlorine line 33 and depleted brine recovery through brine line 27. The permionic membrane 51 is then on the hollow anode 21 or separated therefrom by spacers, not shown, as a fluorocarbon net, mesh, or screen.

According to an alternative exemplification, the electrolytic cell tank 1 is a titanium lined tank or a fluorocarbon resin lined tank having brine feed 16, chlorine recovery 18 and depleted brine recovery 19. Planar anodes 65 depend from anode bus bars 62 through anode risers 63. Hollow cathodes 21 are fabricated of iron, steel, stainless steel, or low carbon mild steel, with water feed 31, hydrogen recovery 33 and hydroxyl ion recovery 27 to hydroxyl ion header 28. In the alternative exemplification herein described, permionic membranes on the cathodes 21 are separated therefrom by fluorocarbon spacers, nets, screen or the like.

As herein contemplated, brine is fed into the anolyte compartment or compartments of the electrolytic cell and electric potential is imposed across the electrolytic cell from the anode bus bars to the cathode bus bars. The electrical potential causes current to flow from a power supply to the anodes and through the electrolyte to the cathodes. Chlorine is recovered from the anolyte compartment while hydrogen gas and cell liquor are recovered from the catholyte compartment of the cell. Typically, the brine feed is concentrated brine containing from about 300 to about 325 grams per liter of sodium chloride or from 400 to about 450 grams per liter of potassium chloride. Where the synthetic separator 51 is a microporous diaphragm, the catholyte cell liquid typically contains approximately 120 to 225 grams per liter of sodium chloride, and approximately 110 to 150 grams per liter of sodium hydroxide, or alternatively, approximately 150 to about 250 grams per liter of potassium chloride and from about 160 to about 225 grams per liter of sodium hydroxide. However, where the synthetic separator 51 is a permionic membrane, the catholyte liquor may contain up to 45 to 50 weight percent sodium hydroxide or up to about 65 weight percent potassium hydroxide to be substantially free of sodium chloride or potassium chloride.

While the invention has been described with reference to certain specific exemplifications and embodiments thereof, it is not intended to be so limited except insofar as appears in the accompanying claims.

What is claimed is:

1. An electrolytic cell comprising:

(a) an electrolyte tank having a top, a bottom, and sidewalls;

(b) planar first electrodes, substantially parallel to, spaced from, and electrically in parallel with each other, in said electrolyte tank;

(c) hollow second electrodes of opposite polarity to and interleaved between said planar first electrodes, said hollow second electrodes being substantially parallel to, spaced from, and electrically in parallel with each other;

(d) ion permeable separator means on the external surfaces of said hollow second electrodes between said planar first electrodes and said hollow second electrodes; and (e) first bus bar means above said electrolyte tank, electrically and mechanically in series with said planar first electrodes through the electrolyte tank top, and second bus bar means above said electrolyte tank, electrically and mechanically in series with said hollow second electrodes through the electrolyte tank top.

2. The electrolytic cell of claim 1 wherein said hollow second electrodes are electrolytically active on the sides parallel to the planar first electrodes.

3. The electrolytic cell of claim 2 wherein the synthetic separator is ion permeable on the surfaces bearing upon electrolytically active surfaces of the hollow second electrodes.

4. The electrolytic cell of claim 1 wherein the planar first electrode is cathodic with respect to the hollow second electrode.

5. The electrolytic cell of claim 1 comprising means for feeding liquid to each of said hollow second electrodes in parallel.

6. The electrolytic cell of claim 1 comprising means for recovering gaseous product from each of said hollow second electrodes in parallel.

7. The electrolytic cell of claim 1 wherein each of said hollow second electrodes has two vertical active sides facing a pair of adjacent planar first electrodes and comprise:

(a) an electrolyte impermeable top comprising electrolyte feed means; gaseous product recovery means; and electrical conduction means;

(b) an electrolyte impermeable bottom; and (c) electrolyte recovery means.

8. An electrolytic cell comprising:

(a) an electrolyte tank having a top, a bottom, and sidewalls;

(b) planar first electrodes, substantially parallel to, spaced from, and electrically in parallel with each other, in said electrolyte tank;

(c) hollow second electrodes of opposite polarity to and interleaved between said planar first electrodes, said hollow second electrodes being substantially parallel to, spaced from, and electrically in parallel with each other; said hollow electrode being rectangular with two vertical active sides facing a pair of adjacent planar first electrodes; said hollow electrode having: (1) an electrolyte impermeable top comprising electrolyte feed means, gaseous product recovery means, and electrical conduction means; (2) an electrolyte impermeable bottom; and (3) electrolyte recovery means;

(d) ion permeable separator means on the external surfaces of said hollow second electrodes between said planar first electrodes and said hollow second electrodes;

(e) first bus bar means above said electrolyte tank, electrically and mechanically in series with said planar first electrodes through the electrolyte tank top; and (f) second bus bar means above said electrolyte tank, electrically and mechanically in series with said hollow second electrodes through the electrolyte tank top.

9. The electrolytic cell of claim 8 wherein the synthetic separator is ion permeable on the surface bearing upon electrolytically active surfaces of the hollow second electrodes.

* * * * *